US006224193B1

(12) United States Patent
Minemoto et al.

(10) Patent No.: US 6,224,193 B1
(45) Date of Patent: May 1, 2001

(54) INKJET RECORDING APPARATUS HAVING GATE ELECTRODES AND PRINT HEAD THEREOF

(75) Inventors: Hitoshi Minemoto; Yoshihiro Hagiwara; Junichi Suetsugu; Tadashi Mizocuchi; Hitoshi Takemoto; Kazuo Shima; Toru Yakushiji, all of Niigata (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 08/956,065

(22) Filed: Oct. 22, 1997

(30) Foreign Application Priority Data

Oct. 22, 1996 (JP) ..... 8-279209

(51) Int. Cl.[7] ..... B41J 2/06
(52) U.S. Cl. ..... 347/55
(58) Field of Search ..... 347/55, 120, 151, 347/154, 17, 128, 127, 159, 111, 103, 123; 399/271, 290, 292, 293, 294, 295

(56) References Cited

U.S. PATENT DOCUMENTS 4,477,869 10/1984 Rudd, III .
4,504,844 3/1985 Ebi et al. .
4,684,957 8/1987 Miura et al. .
5,742,412 * 4/1998 Minemoto et al. ..... 347/55
5,886,723 * 3/1999 Kubelik et al. ..... 347/120

FOREIGN PATENT DOCUMENTS 0 703 080 * 3/1996 (EP) ..... 347/55
0813965 12/1997 (EP) .
60-228162 11/1985 (JP) .
93/11866 6/1993 (WO) .

* cited by examiner

*Primary Examiner*—John Barlow
*Assistant Examiner*—Raquel Yvette Gordon
(74) *Attorney, Agent, or Firm*—Ostrolenk, Faber, Gerb & Soffen, LLP

(57) ABSTRACT

An inkjet device having a plurality of ejection electrodes includes a gate electrode plate having a plurality of gate electrodes therein corresponding to the ejection electrodes, respectively. A voltage difference between the ejection electrode and the gate electrode is generated and is changed between a first value and a second value depending on an input signal. The first value is equal to or greater than a threshold value and the second value is smaller than the threshold value. The threshold value is a minimum value which can cause ejection of particulate matter from each ejection electrode.

19 Claims, 7 Drawing Sheets

FIG.7A
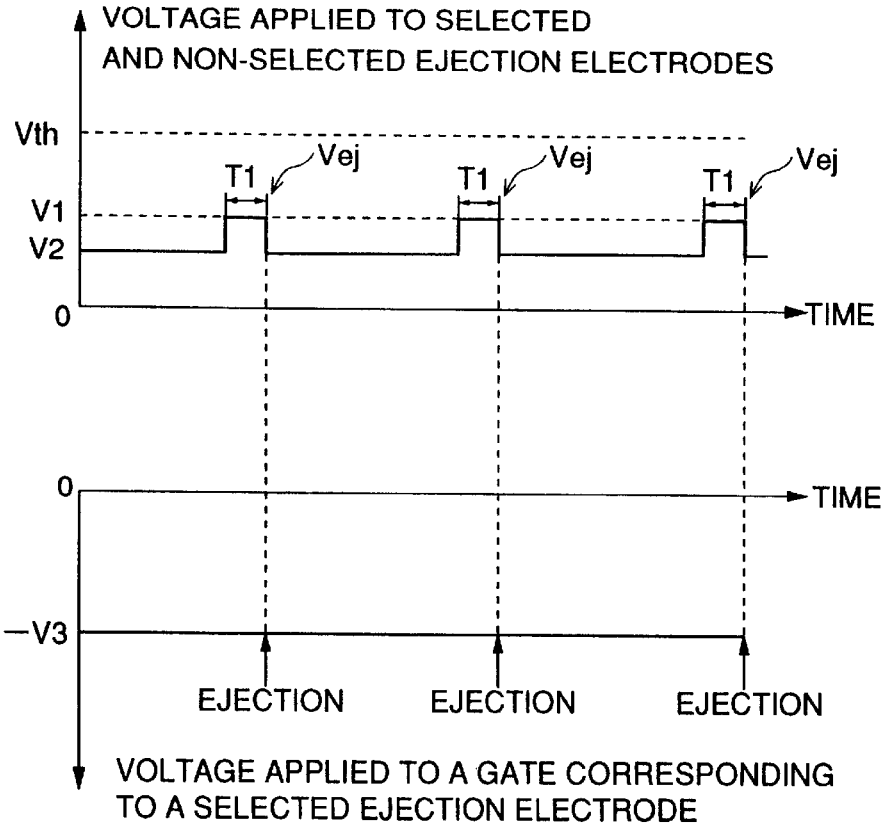
FIG.7B
FIG.7C
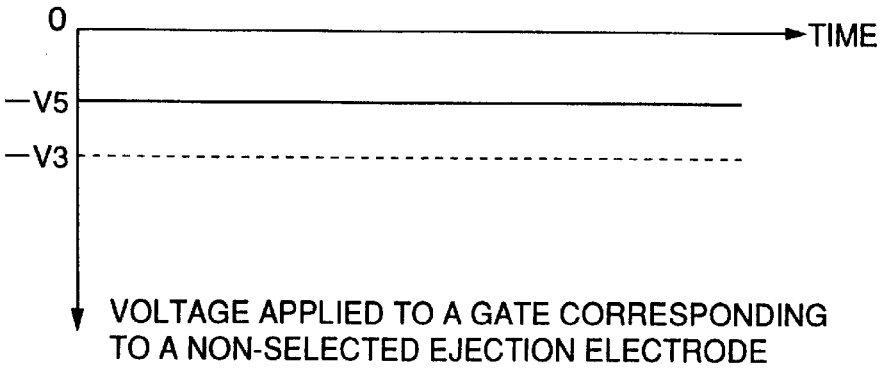

INKJET RECORDING APPARATUS HAVING GATE ELECTRODES AND PRINT HEAD THEREOF

BACKGROUND OF THE INVENTION

1. Field of the Invention

The present invention relates to an inkjet recording apparatus which is capable of ejecting particulate matter such as pigment matter and toner matter by making use of an electric field, and more particularly to control for the inkjet recording apparatus.

2. Description of the Related Art

There has recently been a growing interest in non-impact recording methods, because noise while recording is extremely small to such a degree that it can be neglected. Particularly, inkjet recording methods are extremely effective in that they are structurally simple and that they can perform high-speed recording directly onto ordinary medium. As one of the inkjet recording methods, there is an electrostatic inkjet recording method.

The electrostatic inkjet recording apparatus generally has an electrostatic inkjet recording head and a counter electrode which is disposed behind the recording medium to form an electric field between it and the recording head. The electrostatic inkjet recording head has an ink chamber which temporarily stores ink containing toner particles and a plurality of ejection electrodes formed near the end of the ink chamber and directed toward the counter electrode. The ink near the front end of the ejection electrode forms a concave meniscus due to its surface tension, and consequently, the ink is supplied to the front end of the ejection electrode. If positive voltage relative to the counter electrode is supplied to a certain ejection electrode of the head, then the particulate matter in ink will be moved toward the front end of that ejection electrode by the electric field generated between the ejection electrode and the counter electrode. When the coulomb force due to the electric field between the ejection electrode and the counter electrode considerably exceeds the surface tension of the ink liquid, the particulate matter reaching the front end of the ejection electrode is jetted toward the counter electrode as an agglomeration of particulate matter having a small quantity of liquid, and consequently, the jetted agglomeration adheres to the surface of the recording medium. Thus, by applying pulses of positive voltage to a desired ejection electrode, agglomerations of particulate matter are jetted in sequence from the front end of the ejection electrode, and printing is performed. A recording head such as this is disclosed, for example, in Japan Laid-Open Patent Publication No. 60-228162.

Particularly, In the Publication (60-228162), there is disclosed an electrostatic inkjet printer head where a plurality of ejection electrodes are disposed in an slit, and the front end of each ejection electrode is formed on the projecting portion of a head base which projects from the slit. The front end of this projecting portion has a pointed configuration, and the ejection electrode is formed in accordance with the direction of the pointed end. An ink meniscus is formed near the front end of the ejection electrode.

In the conventional electrostatic inkjet device as mentioned above, when voltage pulses are consecutively applied to an ejection electrode in relatively short intervals, the particulate matter is supplied to the front end of the ejection electrode and then is jetted toward the counter electrode. However, in cases where the time interval between voltage pulses is long, the particulate matter withdraws from the front end of the ejection electrode because of reduced electrostatic force during the interval. In such a state, when the voltage pulse is applied, the particulate matter cannot be instantly jetted. Therefore, no ink may be jetted by that ejection electrode, resulting in deteriorated quality of printing.

Further, in the conventional electrostatic inkjet device, an ejection electrode which is not driven is grounded. Therefore, when an ejection electrode is driven and the adjacent ejection electrodes are not driven, an electric field is generated between the driven ejection electrode and the adjacent ejection electrodes. The electric field generated between them causes the particulate matter in the ink to drift away from the driven ejection electrode, resulting in deteriorated quality of printing.

SUMMARY OF THE INVENTION

It is an objective of the present invention to provide an inkjet recording apparatus which can eject ink from an ejection electrode with reliability and stability.

Another objective of the present invention is to provide method and apparatus which are capable of stably forming ink meniscus at an selected ejection electrode.

According to the present invention, an inkjet recording apparatus includes a plurality of ejection electrodes arranged in an ink chamber containing ink including particulate matter and a gate electrode plate. The gate electrode plate has a plurality of gate electrodes therein corresponding to the ejection electrodes, respectively. Each of gate electrodes has an opening therein, wherein each ejection electrode is directed to an opening of a gate electrode corresponding to the ejection electrode. In such a constitution, a controller generates a voltage difference between the ejection electrode and the gate electrode, the voltage difference changing between a first value and a second value depending on an input signal. The first value is equal to or greater than a predetermined value and the second value is smaller than the predetermined value. The predetermined value is a minimum value which causes ejection of particulate matter from each ejection electrode.

According to an aspect of the present invention, when the ejection electrode is selected for ejection, a control voltage varying depending on the input signal may be applied to the ejection electrode and the gate electrodes may be kept at a predetermined voltage to produce the voltage difference. In this case, the control voltage may change between a first voltage and a second voltage depending on the input signal when the ejection electrode is selected for ejection and the second voltage may be applied to the ejection electrodes other than the ejection electrode which is selected for ejection, wherein the first voltage is applied to the ejection electrode for a predetermined period to perform ejection of particulate matter and the second voltage is applied to the ejection electrode during periods other than the predetermined period.

According to another aspect of the present invention, a first control voltage varying depending on the input signal may be applied to the ejection electrodes and a second control voltage changing depending on the input signal may be applied to the gate electrode to produce the voltage difference. In this case, the first control voltage may change between a first voltage and a second voltage depending on the input signal such that the first voltage is applied to the ejection electrodes for a predetermined period and the second voltage is applied to the ejection electrodes during periods other than the predetermined period. The second control voltage may change between a third voltage and a fourth voltage depending on the input signal such that the third voltage is applied to the gate electrode corresponding to the ejection electrode when the ejection electrode is selected for ejection and otherwise the fourth voltage is applied to the gate electrode.

BRIEF DESCRIPTION OF THE DRAWINGS

The above and other objects and advantages will become apparent from the following detailed description when read in conjunction with the accompanying drawings wherein:

FIG. 7A is a waveform diagram showing a voltage applied to selected and non-selected ejection electrodes of the inkjet recording apparatus according to the second embodiment;

FIG. 7B is a waveform diagram showing a voltage applied to a gate electrode corresponding to the selected ejection electrode of the inkjet recording apparatus according to the second embodiment; and FIG. 7C is a waveform diagram showing a voltage applied to a gate electrode corresponding to the non-selected ejection electrode of the inkjet recording apparatus according to the second embodiment.

DETAILED DESCRIPTION OF THE PREFERRED EMBODIMENTS

Figure 1A:
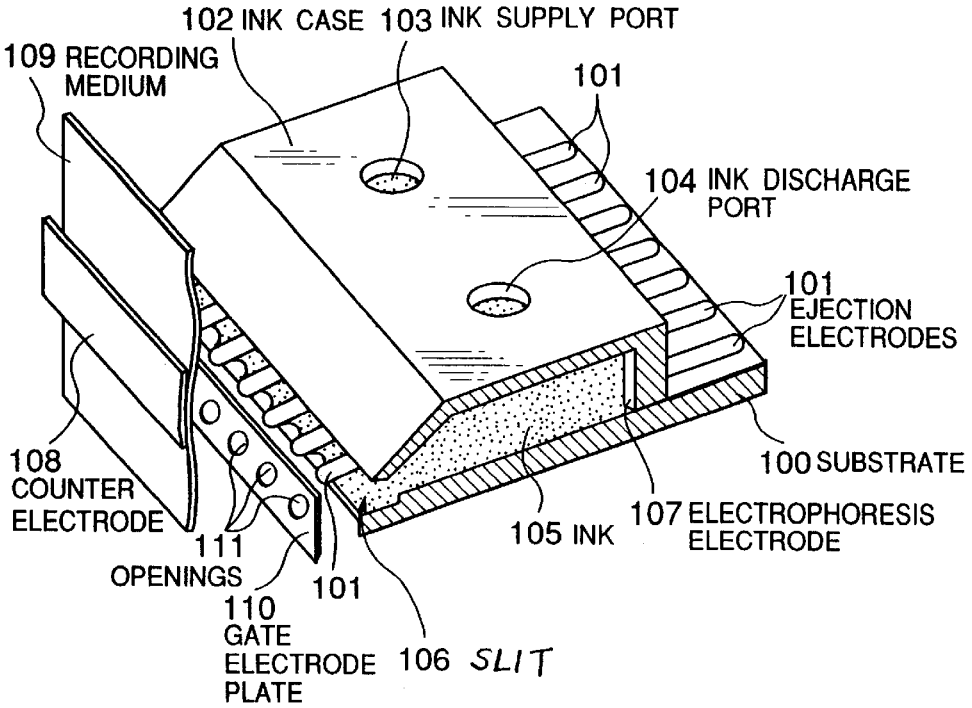
FIG. 1A is a part-fragmentary perspective view showing the schematic constitution of an inkjet recording apparatus according to the present invention.
Figure 1B:
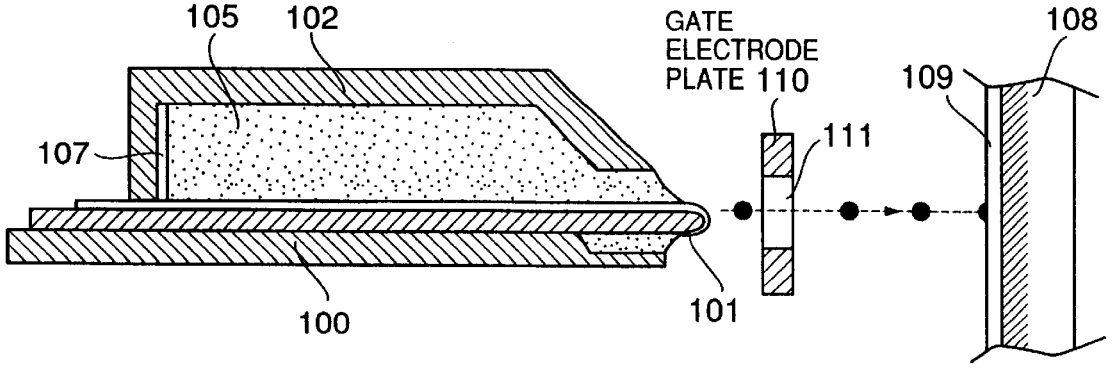
FIG. 1B is a cross sectional view showing the inkjet recording apparatus as shown in FIG. 1A.

Referring to FIGS. 1A and 1B, there is shown an electrostatic inkjet recording head to which the present invention can be applied. A substrate 100 is made of an insulator such as plastic and has a plurality of needle-like ejection electrodes 101 formed thereon in accordance with a predetermined pattern. The portions of the ejection electrodes 101 in the ink chamber are covered with an insulating film. An ink case 102 made of an insulating material is mounted on the substrate 100. The ink case 102 is formed with an ink supply port 103 and an ink discharge port 104. The space, defined by the substrate 100 and the ink case 102, constitutes an ink chamber which is filled with ink 105 containing toner particles which is supplied through the Ink supply port 103. The front end of the ink case 102 is cut out to form a slit 106 between the ink case 102 and the substrate 100. The ejection ends of the election electrodes 101 are disposed in the slit 106.

At the inner rear end of the ink case 102, an electrophoresis electrode 107 is provided within the ink chamber. The ejection electrodes 101 are directed to a counter electrode 108 on which a recording medium 109 is placed.

Further, a gate electrode plate 110 which is provided with a plurality of openings 111 is placed at a predetermined position between the slit 106 and the counter electrode 108 such that the openings 111 correspond to the ejection electrodes 101, respectively. In other words, a small group of ink particles is jetted from a selected ejection electrode to the recording medium 109 through the corresponding opening of the gate electrode plate 110 as shown in FIG. 1B. Each opening 111 may be shaped like a circle or a slit.

As will be described later, a negative voltage $-V_G$is applied to a gate electrode and a negative voltage $-Vc(<-V_G)$ is applied to the counter electrode 108. Therefore, if a voltage with the same polarity as toner particles is applied to the electrophoresis electrode 107, then an electric field will be generated in the ink chamber, causing toner particles to be moved toward the front end of the ejection electrodes 101 due to the electrophoresis phenomenon. In this state, when an ejection voltage pulse is applied to an ejection electrode to generate a voltage difference more than a threshold between the ejection electrode and the corresponding gate electrode, the particulate matter is jetted from the front end of that ejection electrode to the recording medium 109 though the corresponding opening of the gate electrode plate 110.

First Embodiment

Figure 2:
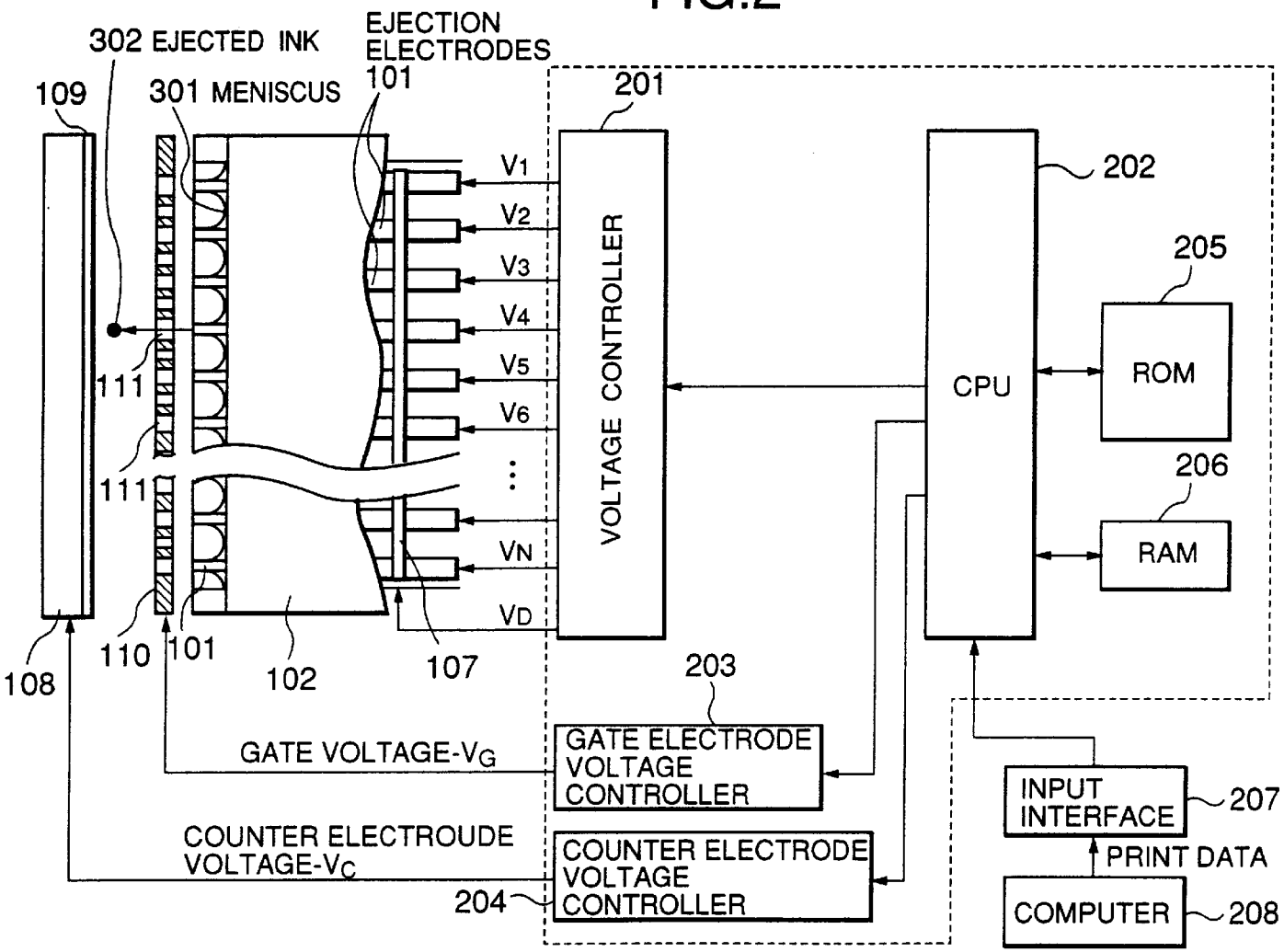
FIG. 2 is a block diagram showing a circuit configuration which drives the inkjet recording apparatus according to a first embodiment of the present invention.

FIG. 2 shows a circuit of a first embodiment according to the present invention, where elements of the inkjet device similar to those previously described with reference to FIGS. 1A and 1B are denoted by the same reference numerals. In the embodiment, the respective openings 111 of the gate electrode plate 110 has gate electrodes which are connected to each other. Therefore, the gate electrode plate 110 may be formed by making the circular openings 111 in a conductive plate such as metal using a laser, for example.

A voltage controller 201 generates control voltages $V_1$-$V_N$ under the control of a processor (CPU) 202 and outputs them to the ejection electrodes 101, respectively. Each of the control voltages $V_1V_N$ is selectively set to an ejection voltage V1 and a non-ejection voltage V2 which is lower than V1 depending on whether the corresponding ejection electrode is selected by the processor 202.

A gate electrode voltage controller 203 generates the gate voltage $-V_G$ which is applied to the gate electrode plate 110 under the control of the processor 202. A counter electrode voltage controller 204 generates the counter electrode voltage $-Vc$ which is applied to the counter electrode 108 under the control of the processor 202.

The processor 202 performs the drive control of the inkjet device according to a control program stored in a read-only memory 205 and controls the voltage controller 201 depending on print data received from a computer 208 through an input interface 207. More specifically, the processor 202 selects one or more (or none) of the ejection electrodes 101 depending on the print data and controls the voltage controller 201 so that a first voltage is output to a selected ejection electrode. At the same time, a second voltage which may be lower than the first voltage is applied to a non-selected ejection electrode.

Further, the processor 202 instructs the voltage controller 201 to apply a predetermined positive voltage $V_D$ to the electrophoresis electrode 107 after power-on. The predetermined voltage $V_D$ applied to the electrophoresis electrode 107 causes an electric field to be generated in the ink chamber. The electric field moves the particulate matter such as toner particles toward the front end of the ejection electrodes 101 due to the electrophoresis phenomenon and then the meniscuses 301 are formed around the ejection electrodes 101, respectively. The voltage control of the ejection electrodes 101, the gate electrodes and the counter electrode 108 will be described in detail hereinafter.

In general, the ink ejection from an ejection electrode requires that a voltage difference between the ejection electrode and the corresponding gate electrode is equal to or greater than a predetermined threshold value $V_{th}$. If the voltage difference is smaller than the threshold value $V_{th}$, the ink ejection from that ejection electrode cannot occur. Therefore, by controlling the voltage difference between each ejection electrode and the corresponding gate electrode, the ejection electrodes selectively eject ink particles. In the embodiment, since the gate electrodes are electrically connected to each other, the gate electrode voltage controller 203 applies the gate voltage $-V_G$ to the gate electrode plate 110.

Figure 3A:
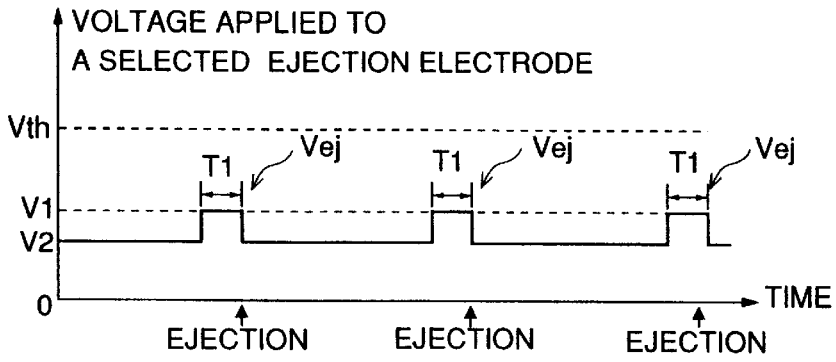
FIG. 3A is a waveform diagram showing a voltage applied to a selected ejection electrode of the inkjet recording apparatus according to the first embodiment.
Figure 3B:
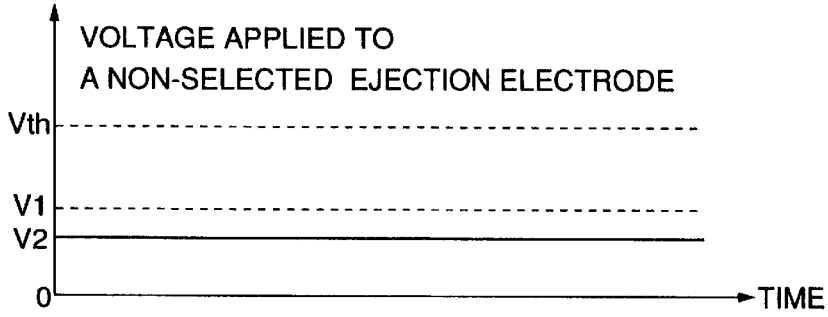
FIG. 3B is a waveform diagram showing a voltage applied to a non-selected ejection electrode of the inkjet recording apparatus according to the first embodiment.
Figure 3C:
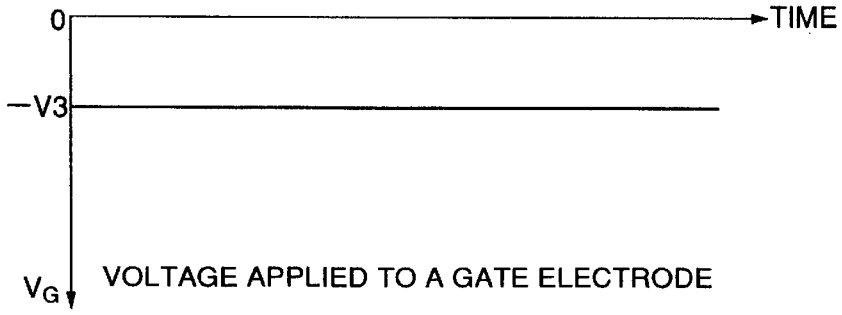
FIG. 3C is a waveform diagram showing a voltage applied to a gate electrode of the inkjet recording apparatus according to the first embodiment.
Figure 3D:
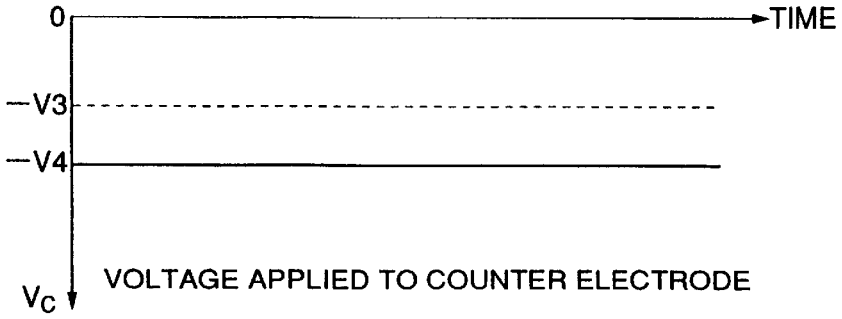
FIG. 3D is a waveform diagram showing a voltage applied to a counter electrode of the inkjet recording apparatus according to the first embodiment.

Referring to FIGS. 3A–3D, when powered, the processor 202 controls the voltage controller 201 such that a positive voltage pulse Vej having a peak voltage V1 and a pulse width of T1 is applied to a selected ejection electrode and a positive voltage V2 is applied during intervals between the positive voltage pulses (see FIG. 3A), and that the positive voltage V2 is applied to a non-selected ejection electrode (see FIG. 3B). Further, the processor 202 controls the gate electrode voltage controller 203 and the counter electrode voltage controller 204 such that a negative gate voltage −V3 is applied to the gate electrode plate 110 (see FIG. 3C) and a negative voltage −V4 lower than −V3 is applied to the counter electrode 108 (see FIG. 3D). In this case, it is important to set the voltages V1, V2, and −V3 so as to satisfy the following relationship:

$$-V3<0<V2<V1<V_{th},$$

$$V1+V3 \geqq V_{th} \text{ and}$$

$$V2+V3<V_{th},$$

Where V3 is the absolute value of −V3.

As described before, the ink ejection occurs only when a voltage difference between the ejection electrode and the corresponding gate electrode is equal to or greater than the threshold value $V_{th}$. Therefore, in the case where $V1+V3 \geqq V_{th}$, that is, the voltage difference between V1 and −V3 is not smaller than $V_{th}$, the selected ejection electrode ejects ink particles on the falling edge of each positive voltage pulse Vej as shown in FIG. 3A. Since $V2+V3<V_{th}$, no ink ejection occurs when the positive voltage V2 is applied during intervals between the positive voltage pulses as in the case of the non-selected ejection electrode as shown in FIG. 3B. Further, since the positive voltage V2 is applied to the selected ejection electrode during intervals between the positive voltage pulses, the drift of particulate matter included in the ink from the selected ejection electrode to the non-selected ejection electrode is substantially reduced.

Figure 4:
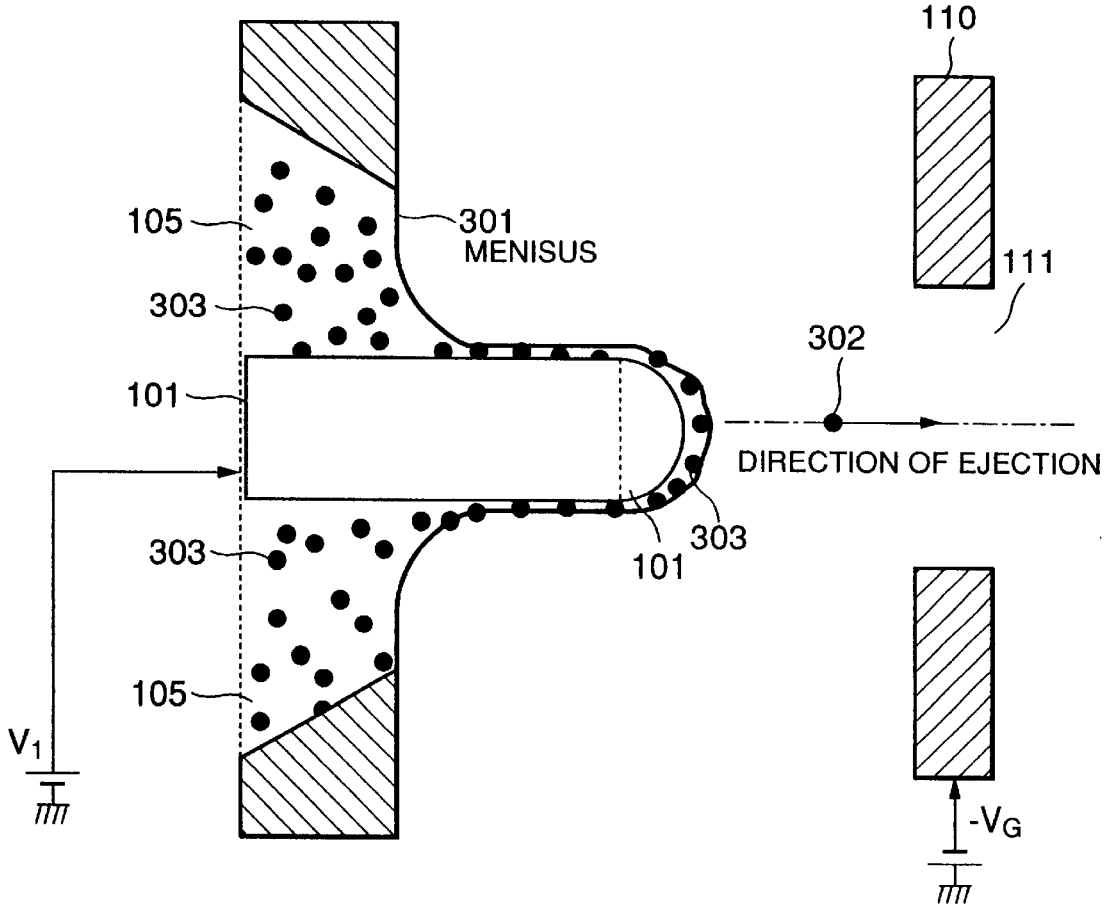
FIG. 4 is an enlarged part-plan view of an slit of the inkjet recording apparatus for explanation of advantages of the present invention.

As shown in FIG. 4, when the voltage V1 is applied to an ejection electrode 101, the particulate matter 303 is concentrated onto the front end of the ejection electrode 101 and then the ink particles 302 are instantly jetted on the falling edge of the voltage pulse Vej. The jetted ink particles 302 travels along the electric field between the ejection electrode (V1) and the corresponding gate electrode (−V3) and then passes through the corresponding opening by an inertial force to reach the recording medium 109 on the counter electrode 108 (−V4). To attract the jetted ink particles 302, the voltage −V4 applied to the counter electrode 108 may be equal to the voltage −V3 applied to the gate electrode.

Figure 5:
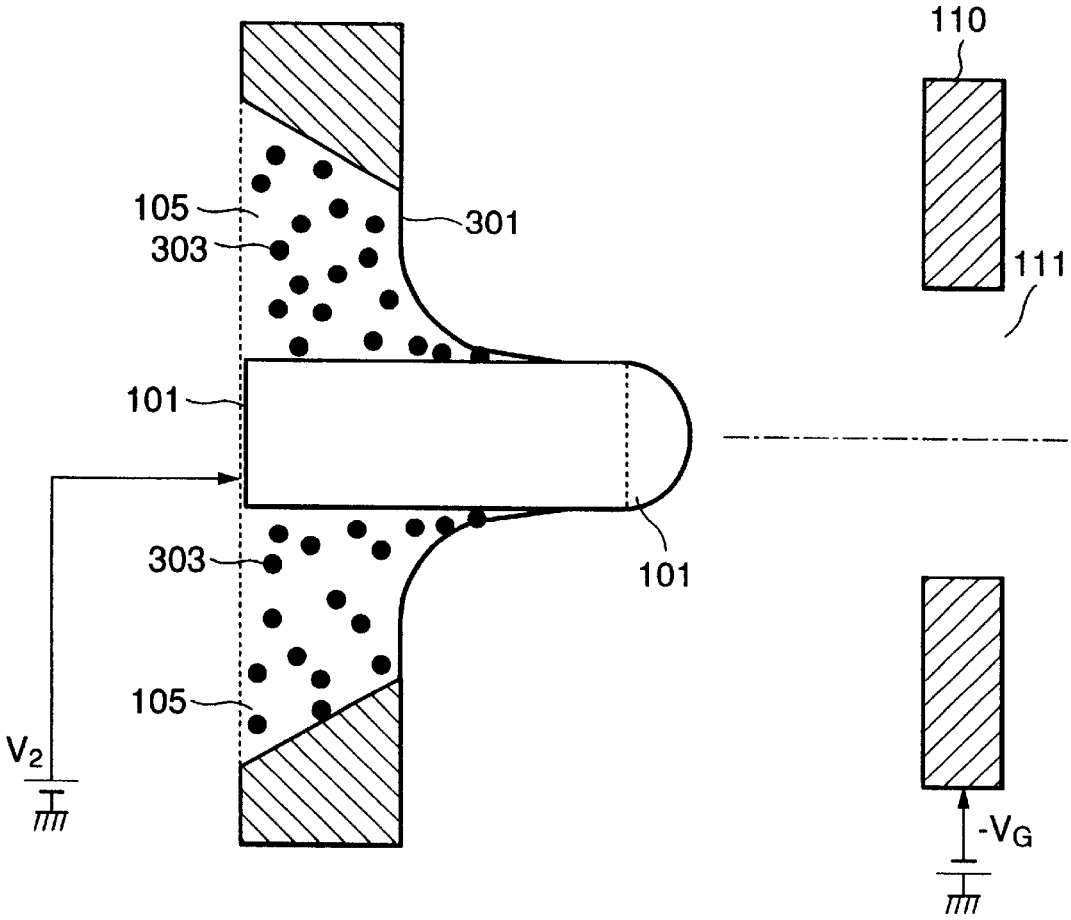
FIG. 5 is an enlarged part-plan view of an slit of the conventional inkjet recording apparatus.

As shown in FIG. 5, contrarily, in cases where the voltage V2 smaller than V1 is applied to the ejection electrode 101, the particulate matter 303 withdraws from the front end of the ejection electrode due to the surface tension of the ink liquid but concentrates around the ejection electrode as shown in the figure.

Second Embodiment

Figure 6:
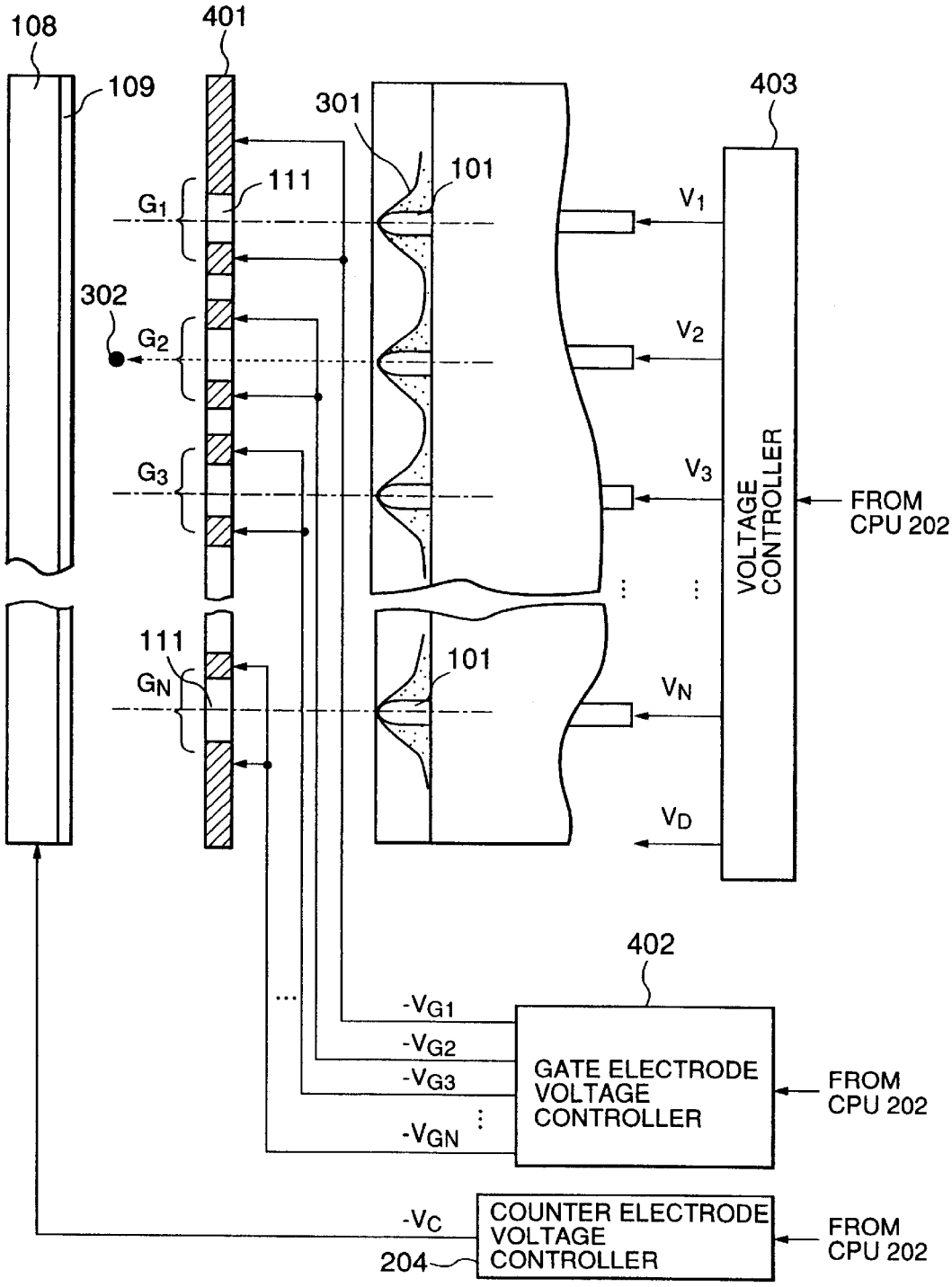
FIG. 6 is a block diagram showing a part of the circuit configuration which drives an inkjet recording apparatus according to a second embodiment of the present invention.

FIG. 6 shows a circuit of a second embodiment according to the present invention, where elements of the inkjet device similar to those previously described with reference to FIGS. 1A and 1B are denoted by the same reference numerals. In the embodiment, a gate electrode plate 401 having the openings 111 therein is placed between the ejection electrodes 101 and the counter electrode 108 as in the case of FIG. 2. The respective openings 111 of the gate electrode plate 401 has gate electrodes $G_1$-$GN_N$ which are electrically insulated from each other.

A gate electrode voltage controller 402 generates gate voltages $-V_{G1}$ to $-V_{GN}$ which are applied to the gate electrodes $G_1$ -$G_N$, respectively, under the control of the processor 202. More specifically, the gate electrode corresponding to a selected ejection electrode is set to a negative voltage −V3 and that corresponding to a non-selected ejection electrode is set to another negative voltage −V5 which is higher than −V3.

A voltage controller 403 generates control voltages $V_1$-$V_N$ and outputs them to the ejection electrodes 101, respectively, under the control of the processor 202. The control voltages $V_1$-$V_N$ have the same voltage waveform. More specifically, when at least one ejection electrode is selected for ink ejection according to the print data, all the control voltages $V_1$-$V_N$ are set to the voltage V1 and the voltage V2 under the control of the processor 202. In other words, according to the second embodiment, there is substantially no voltage difference between any two adjacent ejection electrodes.

Referring to FIGS. 7A–7C, when powered, the processor 202 controls the voltage controller 403 such that a positive voltage pulse Vej having a peak voltage V1 and a pulse width of T1 is applied to both selected and non-selected ejection electrodes and a positive voltage V2 (<V1) is applied to them during intervals between the positive voltage pulses Vej (see FIG. 7A). The processor 202 controls the gate electrode voltage controller 402 such that a negative gate voltage −V3 is applied to the gate electrode corresponding to the selected ejection electrode (see FIG. 7B) and a negative voltage −V5 (>-V3) is applied to the gate electrode corresponding to the non-selected ejection electrode (see FIG. 7C). As in the case of FIG. 3D, the negative voltage −V4 which is equal to or lower than −V3 is applied to the counter electrode 108. In this case, it is important to set the voltages V1, V2, −V3, −V4, and −V5 so as to satisfy the following relationship:

$$-V4<-V3<-V5<0<V2<V1<V_{th},$$

$$V1+V3 \geqq V_{th} \text{ and}$$

$$V1+V5<V_{th},$$

where V3 and V5 are the absolute values of −V3 and −V5, respectively.

As described before, the ink ejection occurs only when a voltage difference between the ejection electrode and the corresponding gate electrode is equal to or greater than the threshold value $V_{th}$. Therefore, in the case where $V1+V3 \geqq V_{th}$, that is, the voltage difference between V1 and −V3 is not smaller than $V_{th}$, the selected ejection electrode ejects ink particles on the falling edge of each ejection positive voltage pulse Vej as shown in FIGS. 7A and 7B. When $V1+V5<V_{th}$, no ink ejection occurs. Further, since the same positive voltage wave form is applied to both selected and non-selected ejection electrodes at all times as shown in FIG. 7A, the electric field between adjacent ejection electrodes falls into zero. Therefore, there does not occur the drift of particulate matter included in the ink between the selected and non-selected ejection electrodes, resulting in improved meniscuses 301 formed on the front ends of the ejection electrodes 101.

It should be noted that the respective voltages are set such that the ink ejection occurs only when a voltage difference between the ejection electrode and the corresponding gate electrode is equal to or greater than the threshold value $V_{th}$. Therefore, in the first and second embodiments, the positive voltages V1 and V2 and the negative voltages −V3, −V4 and −V5 should be relatively set so as to satisfy the above relationship. In other words, there is no need to set the gate electrode voltage and the counter electrode voltage to negative voltages as described above.

While the invention has been described with reference to specific embodiments thereof, it will be appreciated by those skilled in the art that numerous variations, modifications, and any combination of the first and second embodiments are possible, and accordingly, all such variations, modifications, and combinations are to be regarded as being within the scope of the invention.

What is claimed is:

1. An inkjet recording apparatus for recording on a recording medium, the apparatus comprising:

an ink chamber for containing ink including particulate matter;

a plurality of ejection electrodes arranged in the ink chamber for ejecting ink toward the recording medium, each election electrode having an election end;

a gate electrode plate arranged outside the ink chamber and having a plurality of gate electrodes therein, each of the gate electrodes corresponding to a respective one of the ejection electrodes;

an opening formed through each gate electrode, wherein each ejection electrode is directed to jet ink particles through the opening of the corresponding gate electrode, such that ink particles ejected from each ejection electrode toward the recording medium pass from the election end of the electrode through the respective opening of the corresponding gate electrode; and a controller for generating a voltage difference between the ejection electrode and the gate electrode, the voltage difference changing between a first value and a second value depending on an input signal, wherein the first value is equal to or greater than a predetermined value and the second value is smaller than the predetermined value, the predetermined value being a minimum value which causes ejection of particulate matter from each ejection electrode.

2. The inkjet recording apparatus according to claim 1, wherein the gate electrodes are electrically connected to each other and the controller generates the voltage difference between the ejection electrode and the gate electrodes.

3. The inkjet recording apparatus according to claim 2, wherein the controller comprises:

a first voltage controller for applying a control voltage to the ejection electrode, the control voltage varying depending on the input signal when the ejection electrode is selected for ejection; and a second voltage controller for applying a predetermined voltage to the gate electrodes, wherein the voltage difference is produced from the control voltage and the predetermined voltage.

4. The inkjet recording apparatus according to claim 3, wherein the control voltage changes between a first voltage and a second voltage depending on the input signal when the ejection electrode is selected for ejection, the second voltage being applied to the ejection electrodes other than the ejection electrode which is selected for ejection, wherein the first voltage is applied to the ejection electrode for a predetermined period to perform ejection of particulate matter and the second voltage is applied to the ejection electrode during periods other than the predetermined period.

5. The inkjet recording apparatus according to claim 2, further comprising:

a counter electrode to which the ejection electrode is directed such that the gate electrode plate is located between the ejection electrodes and the counter electrode, wherein a second voltage difference between the ejection electrodes and the counter electrode is equal to or greater than the voltage difference.

6. The inkjet recording apparatus according to claim 5, wherein the controller comprises:

a first voltage controller for applying a control voltage to the ejection electrode, the control voltage varying depending on the input signal when the ejection electrode is selected for ejection;

a second voltage controller for applying a first predetermined voltage to the gate electrodes, wherein the voltage difference is produced from the control voltage and the predetermined voltage; and a third voltage controller for applying a second predetermined voltage to the counter electrode to produce the second voltage difference.

7. The inkjet recording apparatus according to claim 1, wherein the gate electrodes are electrically isolated from each other and the controller generates the voltage difference between the ejection electrode and the gate electrode.

8. The inkjet recording apparatus according to claim 7, wherein the controller comprises:

a first voltage controller for applying a first control voltage to the ejection electrodes, the first control voltage varying in a predetermined timing; and a second voltage controller for applying a second control voltage to the gate electrode, the second control voltage changing depending on the input signal, wherein the voltage difference is produced from the first and second control voltages.

9. The inkjet recording apparatus according to claim 8, wherein the first control voltage changes between a first voltage and a second voltage such that the first voltage is applied to the ejection electrodes for a predetermined period and the second voltage is applied to the ejection electrodes during periods other than the predetermined period, and the second control voltage changes between a third voltage and a fourth voltage depending on the input signal such that the third voltage is applied to the gate electrode corresponding to the ejection electrode when the ejection electrode is selected for ejection and otherwise the fourth voltage is applied to the gate electrode.

10. The inkjet recording apparatus according to claim 7, further comprising:

a counter electrode to which the ejection electrode is directed such that the gate electrode plate is located between the ejection electrodes and the counter electrode, wherein a second voltage difference between the ejection electrodes and the counter electrode is equal to or greater than the voltage difference.

11. The inkjet recording apparatus according to claim 10, wherein the controller comprises:

a first voltage controller for applying a first control voltage to the ejection electrodes, the first control voltage varying depending on the input signal when at least one ejection electrode is selected for ejection;

a second voltage controller for applying a second control voltage to the gate electrode, the second control voltage changing depending on the input signal, wherein the voltage difference is produced from the first and second control voltages; and a third voltage controller for applying a predetermined voltage to the counter electrode to produce the second voltage difference.

12. An inkjet recording apparatus for recording on a recording medium, the apparatus comprising:

an ink chamber having a slit at a front end thereof and having an electrophoresis electrode at a rear end thereof, the ink chamber containing ink including particulate matter;

a plurality of ejection electrodes arranged in line within the slit of the ink chamber for ejecting ink toward the recording medium, each ejection electrode having an election end;

a gate electrode plate disposed outside the ink chamber and having a plurality of gate electrodes therein and standing at a predetermined position away from the ejection electrodes such that each of the gate electrodes corresponds to a respective one of the ejection electrodes;

an opening formed through each gate electrode, wherein each ejection electrode is directed to jet ink particles through the opening of the corresponding gate electrode, such that ink particles ejected from the ejection end of each ejection electrode toward the recording medium passes through the opening of the corresponding gate electrode;

a counter electrode to which the ejection electrode is directed such that the gate electrode plate is located between the ejection electrodes and the counter electrode; and a controller for generating a first voltage difference between the ejection electrode and the gate electrode and a second voltage difference between the ejection electrode and the counter electrode, the first voltage difference changing between a first value and a second value depending on an input signal and the second voltage difference being equal to or greater than the first voltage difference, wherein the first value is equal to or greater than a predetermined value and the second value is smaller than the predetermined value, the predetermined value being a minimum value which causes ejection of particulate matter from each injection electrode.

13. The inkjet recording apparatus according to claim 12, wherein the controller further generates a third voltage difference between the electrophoresis electrode and the gate electrode plate, the third voltage difference being the same direction as the first and second voltage differences.

14. The inkjet recording apparatus according to claim 12, wherein the gate electrodes are electrically connected to each other and the controller generates the first voltage difference between the ejection electrode and the gate electrodes.

15. The inkjet recording apparatus according to claim 14, wherein the controller comprises:

a first voltage controller for applying a control voltage to the ejection electrode, the control voltage varying between a first voltage and a second voltage depending on the input signal when the ejection electrode is selected for ejection, the second voltage being applied to the ejection electrodes other than the ejection electrode which is selected for ejection, wherein the control voltage comprises a plurality of voltage pulses each having the first voltage and a predetermined pulse width depending on the input signal when the ejection electrode is selected for ejection, wherein the voltage pulses are applied to the ejection electrode to perform ejection of particulate matter and the second voltage is applied to the ejection electrode during intervals between the voltage pulses; and a second voltage controller for applying a predetermined voltage to the gate electrodes, wherein the voltage difference is produced from the control voltage and the predetermined voltage.

16. The inkjet recording apparatus according to claim 12, wherein the gate electrodes are electrically isolated from each other and the controller generates the first voltage difference between the ejection electrode and the gate electrode.

17. The inkjet recording apparatus according to claim 16, wherein the controller comprises:

a first voltage controller for applying a first control voltage to all the ejection electrodes, the first control voltage varying between a first voltage and a second voltage in a predetermined timing, wherein the first control voltage comprises a plurality of voltage pulses having the first voltage and a predetermined pulse width such that the voltage pulses are applied to the ejection electrodes and the second voltage is applied to the ejection electrodes during intervals between the voltage pulses; and a second voltage controller for applying a second control voltage to the gate electrode, the second control voltage changing depending on the input signal, wherein the voltage difference is produced from the first and second control voltages, wherein the second control voltage changes between a third voltage and a fourth voltage depending on the input signal such that the third voltage is applied to the gate electrode corresponding to the ejection electrode when the ejection electrode is selected for ejection and otherwise the fourth voltage is applied to the gate electrode.

18. A control method in an inkjet recording apparatus for recording on a recording medium, the apparatus comprising a plurality of ejection electrodes arranged in an ink chamber containing ink including particulate matter, the ejection electrodes ejecting ink toward the recording medium, and a gate electrode plate having a plurality of gate electrodes therein, each of the gate electrodes corresponding to a respective one of the ejection electrodes, and an opening formed through each gate electrode, wherein each ejection electrode is directed to jet ink particles through the opening of the corresponding gate electrode, such that ink particles ejected from each ejection electrode toward the recording medium pass from the ejection end of the erection electrode through the opening of the corresponding gate electrode, the control method comprising the steps of:

applying a first voltage to the ejection electrode, the first voltage varying between a first level and a second level depending on the input signal when the ejection electrode is selected for ejection, the first voltage being kept at the second level when the ejection electrode is not selected for ejection; and applying a second voltage different from the first voltage to the gate electrodes to producing a voltage difference between the ejection electrode and the gate electrode, the voltage difference changing between a first value and a second value depending on the input signal, wherein the first value is equal to or greater than a predetermined value and the second value is smaller than the predetermined value, the predetermined value being a minimum value which causes ejection of particulate matter from each ejection electrode.

19. A control method in an inkjet recording apparatus for recording on a recording medium, the apparatus comprising an ink chamber containing ink including particulate matter, a plurality of ejection electrodes arranged in the ink chamber for ejecting ink particles toward the recording medium, and a gate electrode plate having a plurality of gate electrodes therein, each of the gate electrodes corresponding to a respective one of the ejection electrodes, and an opening formed through each gate electrode, wherein each ejection electrode is directed to jet ink particles through the opening of the corresponding gate electrode, such that ink ejected from each ejection electrode toward the recording medium passes through the opening of the corresponding gate electrode, the control method comprising the steps of:

applying a first voltage to all the ejection electrodes, the first voltage varying between a first level and a second level in a predetermined timing; and applying a second voltage to the gate electrode corresponding to the ejection electrode which is selected for ejection to produce a voltage difference between the ejection electrode and the gate electrode, the second voltage changing between two different voltages depending on the input signal, the voltage difference changing between the first value and a second value depending on the input signal, wherein the first value is equal to or greater than a predetermined value and the second value is smaller than the predetermined value, the predetermined value being a minimum value which causes ejection of particulate matter from each ejection electrode.

* * * * *